United States Patent [19]

Renault

[11] Patent Number: 4,995,449

[45] Date of Patent: Feb. 26, 1991

[54] RAPID ACTION COUPLING SYSTEM FOR A HEAT EXCHANGER FLUID TANK INTEGRAL WITH AN EXPANSION VESSEL

[75] Inventor: Christophe Renault, Le Chesnay, France

[73] Assignee: Valeo Thermique Moteur Hutchinson, Paris, France

[21] Appl. No.: 421,080

[22] Filed: Oct. 13, 1989

[30] Foreign Application Priority Data

Oct. 13, 1988 [FR] France ..... 88 13489

[51] Int. Cl.[5] ..... F28F 9/00; F16L 39/02

[52] U.S. Cl. ..... 165/76; 165/176; 165/104.32; 285/137.1; 285/921

[58] Field of Search ..... 165/176, 104.32, 178, 165/76; 285/921, 137.1

[56] References Cited

U.S. PATENT DOCUMENTS 4,425,877 1/1984 Fritzenwenger et al. .
4,463,802 8/1984 Villeval ..... 165/104.32
4,765,658 8/1988 Reche ..... 285/921

FOREIGN PATENT DOCUMENTS 0061597 10/1982 European Pat. Off. .
2458379 1/1981 France .

*Primary Examiner*—Albert W. Davis, Jr.
*Attorney, Agent, or Firm*—Dennison, Meserole, Pollack & Scheiner

[57] ABSTRACT

A fluid tank and an expansion vessel are separated from one another by a planar wall portion having two openings communicating with the fluid inlet and outlet compartments, respectively. A coupling device cast en bloc includes a stopper that plugs an opening of the expansion vessel, and two fluid inlet and outlet necks penetrate the stopper and have respective openings that coincide with the openings of the two respective chambers.

12 Claims, 1 Drawing Sheet

RAPID ACTION COUPLING SYSTEM FOR A HEAT EXCHANGER FLUID TANK INTEGRAL WITH AN EXPANSION VESSEL

BACKGROUND OF THE INVENTION

The invention relates to a rapid action coupling system for simultaneously coupling a fluid inlet chamber and a fluid outlet chamber made in the same heat exchanger fluid tank and separated from one another by a partition to an external circuit; the system includes adjacent inlet and outlet openings for the two chambers provided in the fluid tank and a coupling device cast en bloc, provided with at least two fluid passages and arranged to be attached to the fluid tank in such a way that these two fluid passages communicate respectively with the two openings in the fluid tank, as described in French Patent Application FR-A 2579308.

This system may be used with a heat exchanger, in particular for an automobile, that includes a bank of tubes formed either with U-shaped tubes connecting one of the two chambers of the fluid tank to one another or with straight tubes divided into two groups, respectively connecting the two chambers to a second fluid tank located opposite the first one. This rapid action coupling replaces conventional systems, which include an inlet coupling piece and an outlet coupling piece protruding in two mutually remote locations of the fluid tank, and onto which flexible hoses are threaded in separate operations.

However, it has been found that this system has the disadvantage of not being able to be used in the case where the fluid tank is topped with an expansion vessel.

OBJECT AND SUMMARY OF THE INVENTION

The object of the present invention is to obtain a system of the type defined above that is usable when the fluid tank is formed in one piece with an expansion vessel.

According to the invention, the openings are made in a wall portion separating the fluid tank from an expansion vessel, the internal volume of which is adjacent to the two chambers, and the coupling device penetrates into the expansion vessel.

Advantageously, the partition of the fluid tank is substantially planar over its entire length, and the inlet and outlet openings are disposed on either side of the plane of the partition.

The invention also provides that the fluid tank and/or the expansion vessel, on the one hand, and the coupling device, on the other, have means for being interlocked in a coupled position.

In an exemplary embodiment of the invention, the coupling device includes two inlet and outlet necks extending substantially parallel to the separating wall and having respective lateral openings that come to correspond with the inlet and outlet openings, respectively, of the fluid tank.

In an advantageous characteristic, the coupling device includes a stopper penetrated by the inlet and outlet necks and plugging an opening of the expansion vessel.

In an exemplary embodiment, the stopper engages a tubular seat belonging to the part that forms the fluid tank and the expansion vessel; this seat is defined over part its circumference by a flange projecting over the external wall of the fluid tank.

Means are further provided according to the invention for connecting a degassing circuit to the expansion vessel. In that case, the coupling device may include a degassing neck that penetrates the stopper and discharges directly into the expansion vessel.

Further characteristics and advantages of the invention will become more apparent from the ensuing detailed description of an exemplary embodiment, taken in conjunction with the drawings.

DESCRIPTION OF THE PREFERRED EMBODIMENT

Figure 1:
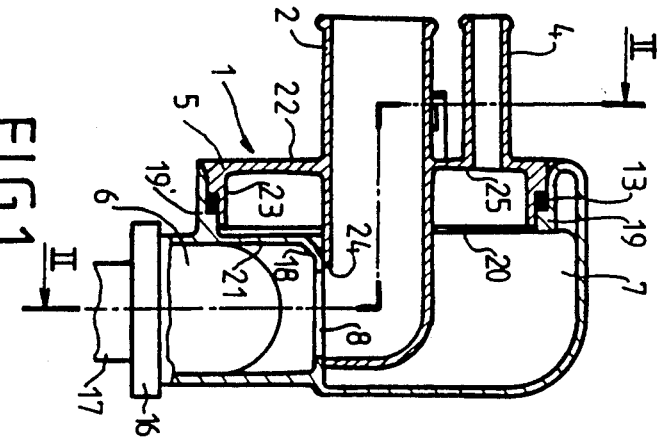
FIG. 1 is a fragmentary elevation view, partly in section in a view taken along I—I of FIG. 2, of an automobile heat exchanger including a rapid action coupling according to the invention.
Figure 2:
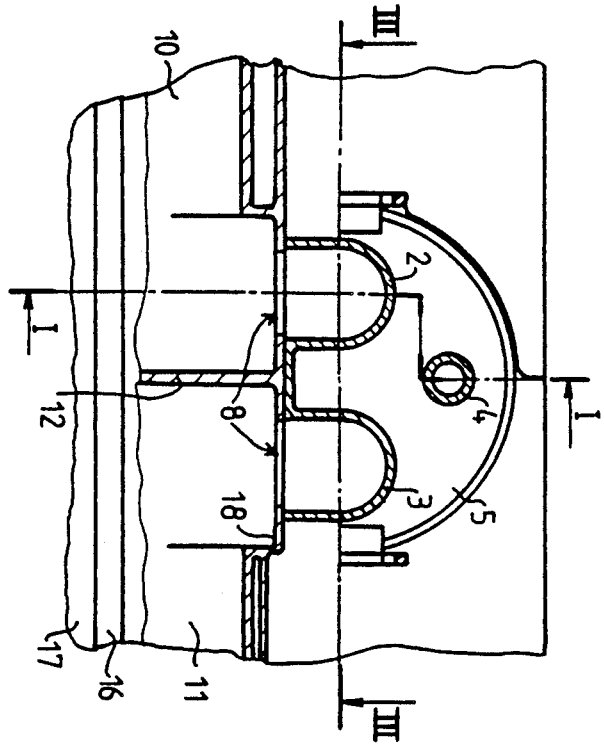
FIG. 2 is a fragmentary view of the exchanger, partly in section, taken along the line II—II of FIG. 1.
Figure 3:
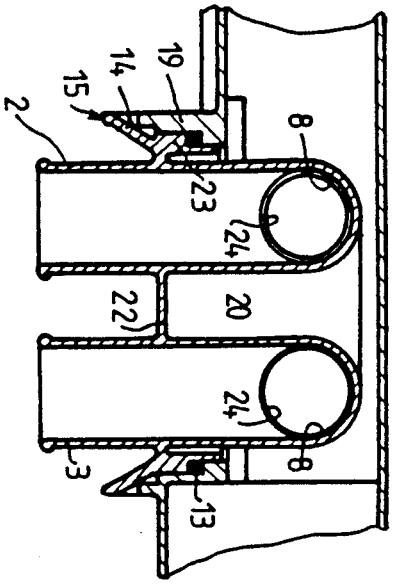
FIG. 3 is a fragmentary sectional view taken along the line III—III of FIG. 2.

FIGS. 1–3 show part of an automobile heat exchanger including at least one fluid tank, here an upper fluid tank 6, associated with a collector 16.

The upper ends of vertically oriented tubes 17 pass through the collector, each end extending over substantially the entire width of the fluid tank 6; the tubes 17 communicate at their lower end with a lower fluid tank (not shown). The fluid tank 6 is topped by an expansion vessel 7 molded in one piece with it. The fluid tank is divided on the interior, in its longitudinal direction, into two chambers 10 and 11 by a planar, transversely extending partition 12. The partition 12, molded in a single piece with the fluid tank, is connected in a sealed manner at its lower end to the collector 16, and is coupled via the remainder of its perimeter to the wall of the fluid tank, and in particular to a planar wall portion 18 in which two circular openings 8 are made on either side of and in proximity with the partition; these openings correspond with the respective chambers 10 and 11. The portion 18 parallel to the collector 16 comprises a separation wall between the chambers 10 and 11 on the one hand and the interior of the expansion vessel on the other, with the water tank and the expansion vessel being spaced apart from one another over the remaining portion of their length. The molded part forming the water tank and the expansion vessel has a tubular sleeve 19 having a horizontal axis, surrounding an opening 20 made in one wall of the expansion vessel. The upper portion of the sleeve 19 faces the expansion vessel and is coupled directly to its wall, while the lower portion of the sleeve comprises a flange 19' projecting over a portion of the lateral wall 21 of the fluid tank.

The coupling device 1 of the system according to the invention, which is molded in one piece, includes a stopper 5 that engages the inside of the sleeve 19 so as to plug the opening 20 of the a expansion vessel. In the example shown, the stopper 5 includes a bottom wall 22 and an annular flange 23 projecting toward the expansion vessel from the periphery of the wall 22. A gasket 13 is disposed between the sleeve 19 and the flange 23. The bottom wall 22 is penetrated by two fluid inlet and outlet necks 2 and 3, the axes of which, like that of the sleeve 19 and the stopper 5, are parallel to the plane of the wall portion 18. The necks 2 and 3 are open at their end located out of the expansion vessel, in order to be coupled to flexible hoses, and their inner ends penetrate this vessel. On the interior of the expansion vessel, the ends of the necks 2 and 3 have lateral openings 24, which when the stopper is suitably wedged in the sleeve come to coincide with the two openings 8 of the respective chambers of the fluid tank. The necks 2 and 3 are shaped so as to press tightly against the face of the wall portion 18 toward the expansion vessel, permitting practically no communication between the interior of the necks and the interior of the expension vessel. A third neck 4, parallel to the necks 2 and 3, projects to the outside beginning at the bottom wall 22 of the stopper for coupling with a degassing circuit, and communicates with the interior of the expansion vessel via its inner end 25 that is coupled to the wall 22.

The coupling device 1 has two flexible legs 14 projecting toward the inside, beginning at the wall 22, and cooperating with openings, formed on ribs 15 that are integral with the expansion vessel and/or the fluid tank, to assure the interlocking of the two parts.

What is claimed is:

1. A rapid action coupling system for simultaneous coupling to an external circuit of a fluid inlet chamber and a fluid outlet chamber (10, 11) made in the same heat exchanger fluid tank and separated from one another by a partition (12), the system including adjacent inlet and outlet openings (8), for the two chambers which are provided in the fluid tank, and a coupling device (1) cast en bloc which is provided with at least two fluid passages (2, 3) and is arranged to be attached to the fluid tank in such a way that these two fluid passages communicate respectively with the two openings in the fluid tank, characterized in that the openings are made in a wall portion (18) separating the fluid tank from an expansion vessel (7) formed in a single piece with it and the internal volume of which is adjacent to the two chambers, and that the coupling device penetrates into the expansion vessel.

2. A system as defined by claim 1, characterized in that the partition (12) of the fluid tank is substantially planar over its entire length, and that the inlet and outlet openings (8) are disposed one on each side of the plane of the partition (12), while being in proximity with it.

3. A system as defined by claim 1, characterized in that the fluid tank and/or the expansion vessel, on the one hand, and the coupling device, on the other, have means (14, 15) for being interlocked in a coupled position.

4. A system as defined by claim 1, characterized in that the coupling device includes two inlet and outlet necks (2, 3) extending substantially parallel to said wall portion (18) and having respective lateral openings (24) that come respectively into correspondence with the inlet and outlet openings (8) of the fluid tank.

5. A system as defined by claim 4, characterized in that the coupling device includes a stopper (5) that is penetrated by the inlet and outlet necks and plugs an opening (20) of the expansion vessel.

6. A system as defined by claim 5, characterized in that the stopper engages a tubular seat (19) belonging to the part that forms the fluid tank and the expansion vessel, this seat being defined over a portion of its circumference by a flange (19') projecting over the external wall (21) of the fluid tank.

7. A system as defined by any one of claims 1–6, characterized in that it further includes means (4, 25) for connecting a degassing circuit to the expansion vessel (7).

8. A system as defined by claim 7, characterized in that the coupling device includes a degassing neck (4) penetrating the stopper (5) and discharging directly into the expansion vessel.

9. A system as defined by claim 2, characterized in that the fluid tank and/or the expansion vessel, on the one hand, and the coupling device, on the other, have means (14, 15) for being interlocked in a coupled position.

10. A system as defined by claims 2 or 3, characterized in that the coupling device includes two inlet and outlet necks (2, 3) extending substantially parallel to said wall portion (18) and having respective lateral openings (24) that come respectively into correspondence with the inlet and outlet openings (8) of the fluid tank.

11. A system as defined by claim 1, characterized in that the partition (12) of the fluid tank is substantially planar over its entire length, the inlet and outlet openings (8) are disposed one on each side of the plane of the partition (12), while being in proximity with it, and the coupling device includes a stopper (5) that is penetrated by the inlet and outlet necks and plugs an opening (20) of the expansion vessel.

12. A system as defined by claim 1, characterized in that the fluid tank and/or the expansion vessel, on the one hand, and the coupling device, on the other, have means (14, 15) for being interlocked in a coupled position, the coupling device includes two inlet and outlet necks (2, 3) extending substantially parallel to said wall portion (18) and having respective lateral openings (24) that come respectively into correspondence with the inlet and outlet openings (8) of the fluid tank, and means (4, 25) for connecting a degassing circuit to the expansion vessel (7).

* * * * *

UNITED STATES PATENT AND TRADEMARK OFFICE

CERTIFICATE OF CORRECTION

PATENT NO. : 4,995,449

DATED : February 26, 1991

INVENTOR(S) : Christophe Renault

It is certified that error appears in the above-identified patent and that said Letters Patent is hereby corrected as shown below:

Title page, in item [73] Assignees: should read as follows:

Valeo Thermique Moteur
Le Mesnil Saint Denis, France

Hutchinson
Paris, France

Signed and Sealed this

Third Day of November, 1992

*Attest:*

DOUGLAS B. COMER

*Attesting Officer*

*Acting Commissioner of Patents and Trademarks*